US006766779B2

(12) United States Patent
Lee

(10) Patent No.: US 6,766,779 B2
(45) Date of Patent: Jul. 27, 2004

(54) AIR INTAKE SYSTEM FOR AN INTERNAL COMBUSTION ENGINE

(75) Inventor: Seung-Suk Lee, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/465,902

(22) Filed: Jun. 18, 2003

(65) Prior Publication Data

US 2004/0107933 A1 Jun. 10, 2004

(30) Foreign Application Priority Data

Dec. 6, 2002 (KR) ..... 10-2002-0077474

(51) Int. Cl.[7] ..... F02M 35/10

(52) U.S. Cl. ..... 123/184.21

(58) Field of Search ..... 123/184.21

*Primary Examiner*—Noah P. Kamen

(74) *Attorney, Agent, or Firm*—Morgan Lewis & Bockius LLP

(57) ABSTRACT

An air intake system for an internal combustion engine is provided which comprises an intake manifold, a stub manifold, a vibration-absorbing member, and a bracket. The stub manifold is disposed between the intake manifold and a cylinder block, and communicates with the intake manifold. The vibration-absorbing member is disposed between the stub manifold and the intake manifold. One end of the bracket is coupled to the stub manifold through a first mounting member, and the other end of the bracket is coupled to the intake manifold through a second mounting member.

5 Claims, 2 Drawing Sheets

AIR INTAKE SYSTEM FOR AN INTERNAL COMBUSTION ENGINE

FIELD OF THE INVENTION

The present invention relates to an air intake system for an internal combustion engine, and more particularly, to an air intake system that is capable of decreasing vibration of a rubber hose employed in a stub manifold in a side of a cylinder head and of an intake manifold.

BACKGROUND OF THE INVENTION

When an internal combustion engine operates at high speed, substantial vibration is generated by the engine, and these vibrations are transmitted to peripheral components of the engine. For example, such vibrations that are generated in the engine are transmitted to the intake manifold via a stay for the intake manifold and the stub manifold.

Generally, an air intake system for an internal combustion engine is provided with a stub manifold made of aluminum, an intake manifold made of a plastic material, and a rubber hose, in order to dampen vibration generated in the engine. If vibration of the engine is dampened in this manner, vibration generated in the intake manifold and a throttle body can be drastically decreased.

The rubber hose that is disposed between the stub manifold and the intake manifold can efficiently decrease vibration transmitted from the stub manifold to the intake manifold. However, vibration transmitted to the intake manifold through the intake manifold stay cannot be decreased under this conventional intake system.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Embodiments of the present invention provide an air intake system for an internal combustion engine that is capable of decreasing vibration of a rubber hose that is transmitted to a stub manifold, and decreasing vibration of an intake manifold that is transmitted through an intake manifold stay.

In a preferred embodiment of the present invention, an air intake system for an internal combustion engine comprises an intake manifold, a stub manifold, a vibration-absorbing member, and a bracket. The stub manifold is disposed between the intake manifold and a cylinder block and communicates with the intake manifold. The vibration-absorbing member is disposed between the stub manifold and the intake manifold. One end of the bracket is coupled to the stub manifold through a first mounting member, and the other end of the bracket is coupled to the intake manifold through a second mounting member.

Preferably, the first mounting member comprises a first fixing boss and a first fixing screw. The first fixing boss is coupled to the stub manifold, and is provided with a threaded portion. The first fixing screw is configured to be coupled to the first fixing boss such that one end of the bracket can be coupled to the first fixing boss.

It is preferable that the second mounting member comprises a second fixing boss, a second fixing screw, and a rubber member. The second fixing boss is coupled to the intake manifold in parallel with the stub manifold, and is provided with a threaded portion. The second fixing screw is configured to be coupled to the first fixing boss such that one end of the bracket can be coupled to the second fixing boss. The rubber member is disposed between the second fixing screw and the bracket to dampen vibration. Preferably, the bracket has an L shape.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
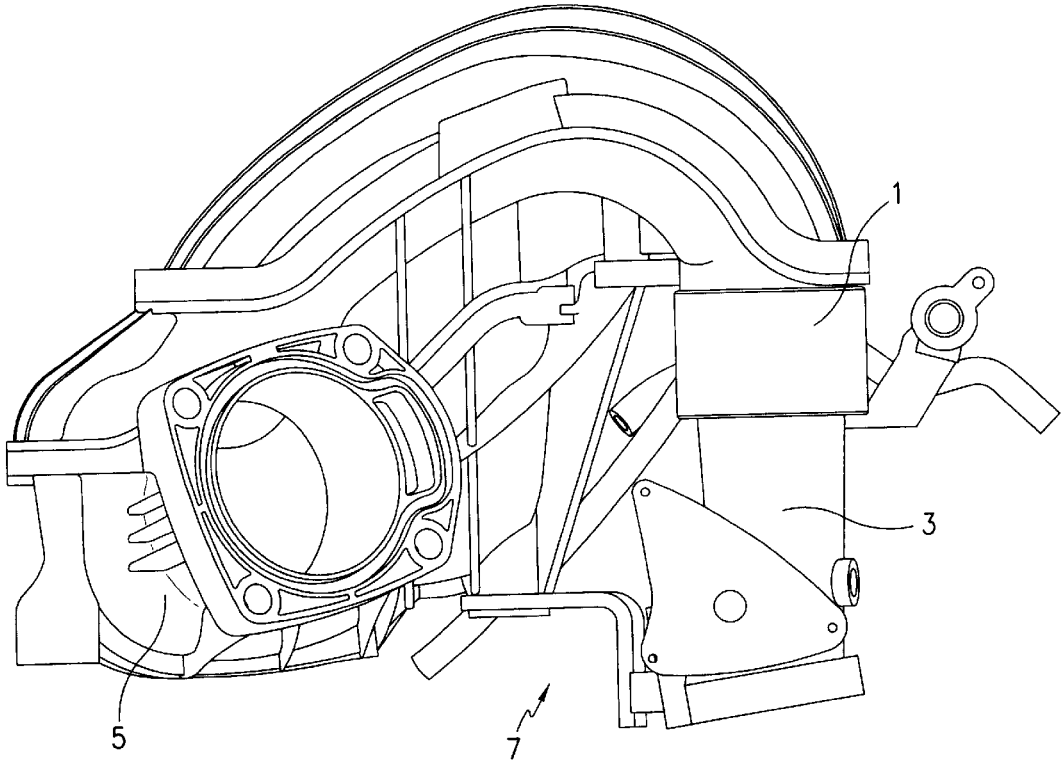
FIG. 1 is a perspective view of the air intake system according to the preferred embodiment of the present invention.

As shown in FIG. 1, an air intake system according to a preferred embodiment of the present invention includes a stub manifold 3 that is configured to be coupled to a cylinder head (not shown). An intake manifold 5 has one or more air passages through which intake air is delivered to a cylinder (not shown).

A rubber hose 1 is disposed between the intake manifold 5 and the stub manifold 3, such that vibration can be dampened between the two. The stub manifold 3 is provided with one or more air passages that communicate with the passages of the intake manifold, in order to deliver air into the cylinder. The stub manifold 3 can be made of a metallic material such as an aluminum alloy, and the intake manifold 5 can be made of a plastic material.

The intake manifold 5 is connected to a cylinder block through a stay (not shown). The stay supports the intake manifold against the cylinder block, and vibration of the engine is transmitted to the intake manifold 5 through the stay. It is required to dampen these vibrations transmitted to the intake manifold 5 through the stay.

Figure 2:
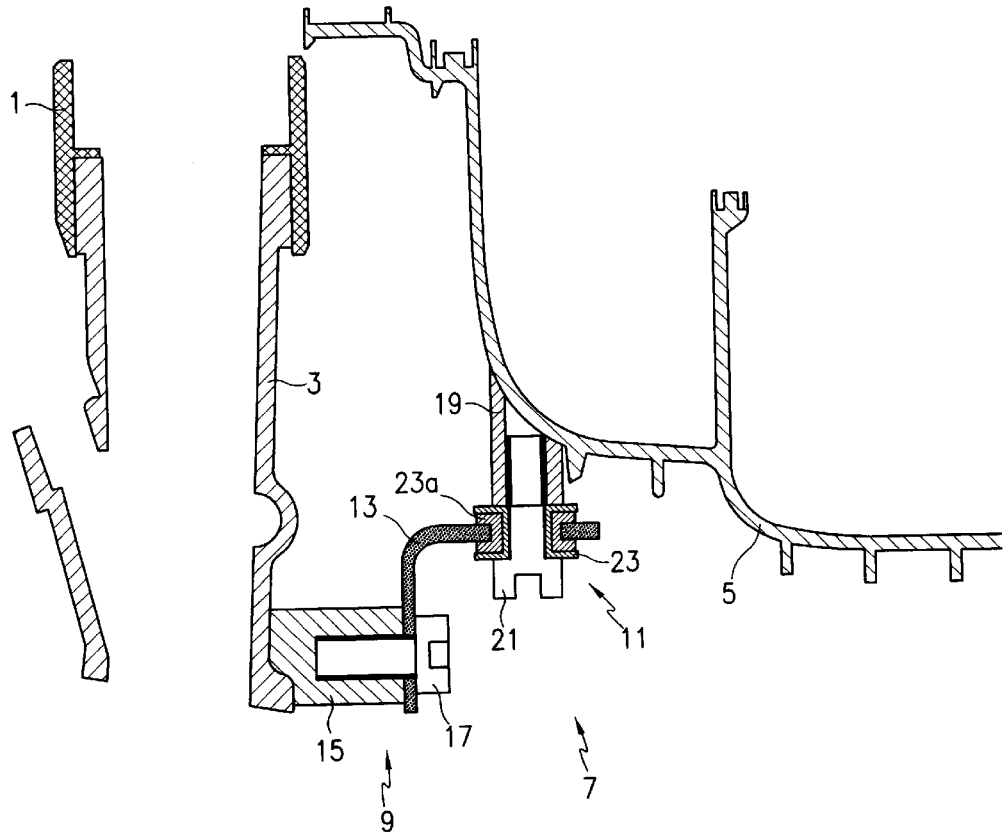
FIG. 2 is a sectional view of the air intake system according to the preferred embodiment of the present invention.

In order to dampen these vibrations, a mounting assembly 7 is provided between the stub manifold 3 and the intake manifold 5. The mounting assembly 7 dampens vibrations generated in the engine, along with the rubber hose 1. As shown in FIG. 2, the mounting assembly 7 includes a first mounting member 9, a second mounting member 11, and a bracket 13.

The first mounting member 9 is provided in the stub manifold 3, and fixes one side of the bracket 13 to the stub manifold 3. The second mounting member 11 is provided in the intake manifold 5, and fixes the other side of the bracket 13 to the intake manifold 3. Consequently, the bracket 3 is configured to connect the stub manifold 3 and the intake manifold 5 together.

The first mounting member 9 comprises a first fixing boss 15 and a first fixing screw 17. An end of the first fixing boss 15 extends toward the intake manifold 5, and the first fixing boss 15 has a threaded portion at an inside thereof to be coupled with the first fixing screw 17. When the first fixing screw 17 is coupled to the first fixing boss 15, one side of the bracket 13 is coupled to the stub manifold 3.

The second mounting member 11 is the reciprocal of the first mounting member 9. The second mounting member 11 comprises a second fixing boss 19, a second fixing screw 21, and an isolator 23. An end of the second fixing boss 19 extends in the same direction as the stub manifold 3. That is, the second fixing boss 19 is coupled to the intake manifold 5 in parallel with the stub manifold 3. The second fixing boss 19 has a threaded portion at an inside thereof to be coupled with the second fixing screw 21. When the second fixing screw 21 is coupled to the second fixing boss 19, the other side of the bracket 13 is coupled to the intake manifold 5.

In addition, the isolator 23 is provided with a rubber member 23*a* disposed between the second fixing screw 21 of the second mounting member 11 and the bracket 13, so that vibration between the second fixing screw 21 and the bracket 13 can be dampened. In this manner, the bracket 13 connects the first and second mounting members 9 and 11 together. The bracket 13 can have various shapes, but in this embodiment, it has an "L" shape so that it contains two plates disposed perpendicular to each other. One plate (for example, a vertical plate) of the bracket 13 is coupled to the stub manifold 3, and the other plate (for example, a horizontal plate) of the bracket 13 is coupled to the intake manifold 5.

If the bracket 13 is standardized in this manner, an assembling error judgment of the rubber hose I can be performed through the shape of the bracket. In the air intake system according to the preferred embodiment of the present invention, vibration of the engine is dampened by the rubber hose 1 near the cylinder, and also by the isolator 23 near the cylinder block.

Although preferred embodiments of the present invention have been described in detail hereinabove, it should be clearly understood that many variations and/or modifications of the basic inventive concepts herein taught which may appear to those skilled in the present art will still fall within the sprit and scope of the present invention, as defined in the appended claims.

Throughout this specification and the claims which follow, unless explicitly described to the contrary, the word "comprise" or variations such as "comprises" or "comprising" will be understood to imply the inclusion of stated elements but not the exclusion of any other elements.

What is claimed is:

1. An air intake system for an internal combustion engine, comprising:

an intake manifold;

a stub manifold disposed between the intake manifold and a cylinder block and communicating with the intake manifold;

a vibration-absorbing member disposed between the stub manifold and the intake manifold; and a bracket with one end coupled to the stub manifold through a first mounting member, and the other end coupled to the intake manifold through a second mounting member.

2. The air intake system of claim 1, wherein the first mounting member comprises:

a first fixing boss coupled to the stub manifold and provided with a threaded portion; and a first fixing screw configured to be coupled to the first fixing boss such that one end of the bracket can be coupled to the first fixing boss.

3. The air intake system of claim 1, wherein the second mounting member comprises:

a second fixing boss coupled to the intake manifold in parallel with the stub manifold, the second fixing boss being provided with a threaded portion;

a second fixing screw configured to be coupled to the first fixing boss such that one end of the bracket can be coupled to the second fixing boss; and a rubber member disposed between the second fixing screw and the bracket to dampen vibrations.

4. The air intake system of claim 1, wherein the bracket has an L shape.

5. An air intake system for an internal combustion engine, comprising:

an intake manifold;

a stub manifold disposed between the intake manifold and a cylinder block and communicating with the intake manifold;

a vibration-absorbing member defining an air flow path between the stub manifold and the intake manifold; and a vibration isolation bracket including a resilient mounting member supporting the stub manifold on the intake manifold.

* * * * *